United States Patent [19]

Sumitomo

[11] 4,291,759

[45] Sep. 29, 1981

[54] CROSS-CURRENT TYPE PLATE HEAT EXCHANGER

[75] Inventor: Hiroyuki Sumitomo, Osaka, Japan

[73] Assignee: Hisaka Works, Limited, Osaka, Japan

[21] Appl. No.: 70,631

[22] Filed: Aug. 28, 1979

[51] Int. Cl.[3] ..... F28F 3/00

[52] U.S. Cl. ..... 165/146; 165/166; 165/170

[58] Field of Search ..... 165/166, 170, 10, 133, 165/146, 167, 152; 29/157.3 D; 113/118 D; 228/183

[56] References Cited

U.S. PATENT DOCUMENTS

| | | | |
|---|---|---|---|
| 2,596,642 | 5/1952 | Boestad | 165/166 |
| 3,016,921 | 1/1962 | Tadewald | 165/166 |
| 3,255,816 | 6/1966 | Rosenblad | 165/166 |
| 3,473,604 | 10/1969 | Tiefenbacher | 165/166 |
| 3,554,273 | 1/1971 | Kritzler | 165/166 |
| 3,757,856 | 9/1973 | Kun | 29/157.3 D |
| 3,931,854 | 1/1976 | Ivakhnenko | 165/166 |
| 3,967,354 | 7/1976 | Jaspers | 29/157.3 D |
| 4,099,928 | 7/1978 | Norback | 29/157.3 D |
| 4,180,129 | 12/1979 | Sumitomo | 165/170 |
| 4,182,411 | 1/1980 | Sumitomo et al. | 165/166 |

*Primary Examiner*—Daniel J. O'Connor
*Attorney, Agent, or Firm*—Armstrong, Nikaido, Marmelstein & Kubovcik

[57] ABSTRACT

A cross-current type plate heat exchanger comprising a plurality of vertically disposed heat transfer plates arranged side by side to define fluid passageways through which two fluids to be heat exchanged flow in a cross-current fashion. Each heat transfer plate is formed with a plurality of juxtaposed vertical grooves extending from the top to the bottom of the heat transfer surface of the heat transfer plate, and a plurality of substantially horizontal projections are formed between the vertical grooves to divide the heat transfer area into a plurality of sections. Vertically extending short projections which are lower than the vertical grooves are formed between the substantially horizontal projections in such a manner that the number of such short projections provided in the vertically separated sections is progressively increased so that the bottommost section has the greatest number of short projections. A labyrinth is defined in a space between a gasket and a seal member, and a gas having a higher pressure than any of the fluids to be heat exchanged is fed to the labyrinth.

2 Claims, 9 Drawing Figures

CROSS-CURRENT TYPE PLATE HEAT EXCHANGER

BACKGROUND OF THE INVENTION

1. Field of the Invention

The present invention relates to a cross-current type plate heat exchanger wherein fluids to be heat exchanged flow in a cross-current fashion such that one fluid flows in a direction which is at right angles to the direction of flow of the other fluid.

2. Description of the Prior Art

In a cross-current type plate heat exchanger comprising a plurality of vertically disposed heat transfer plates arranged side by side to define fluid passageways through which two fluids to be heat exchanged flow in a cross-current fashion, if cooling water is passed in a horizontal direction while vapor is passed in a vertical direction, then the film coefficient is high on the vapor side but it is kept low on the cooling water side because of its characteristics. Therefore, the overall coefficient of heat transfer is determined largely by the cooling water side and hence it is low. The cooling water which horizontally flows laterally of the heat transfer plates can hardly flow uniformly over the entire heat transfer area. That is, the cooling water, as shown in FIGS. 1 and 2, has its rate of flow gradually decreased as it approaches the upper edge of the heat transfer area, so that the width of the major flow is narrowed, creating a dead space. As a result, the flow rate in the upper region is increased, causing an increased pressure loss. Further, such dead space decreases the amount of heat transfer, lowering the rate of heat transfer.

SUMMARY OF THE INVENTION

The present invention eliminates the above described drawbacks inherent in conventional cross-current type plate heat exchangers and is intended to improve the rate of heat transfer and reduce pressure loss and to provide for treatment in large quantities by improving the heat transfer surface of the heat transfer plate.

According to the invention, in a cross-current type plate heat exchanger comprising a plurality of vertically disposed heat transfer plates arranged side by side to define fluid passageways through which two fluids to be heat exchanged flow in a cross current fashion, each heat transfer plate is formed with a plurality of juxtaposed vertical grooves extending from the top to the bottom of the heat transfer surface of the heat transfer plate, and a plurality of substantially horizontal projections are formed between the vertical grooves to divide the heat transfer area into a plurality of sections, while vertically extending short projections which are lower than the vertical grooves are formed between the substantially horizontal projections in such a manner that the number of such short projections provided in the vertically separated sections is progressively increased so that the bottommost section has the greatest number of rectangular projections. A labyrinth is defined in a space between a gasket and a seal member, and a gas having a higher pressure than any of the fluids to be heat exchanged is fed to the labyrinth. Thus, the invention makes it possible to improve the rate of heat transfer, reduce pressure loss and perform treatment in large quantities.

DESCRIPTION OF THE PREFERRED EMBODIMENT

Figure 1:
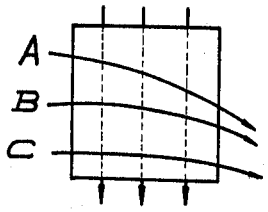
FIGS. 1 and 2 are a flow distribution characteristic diagram and a flow rate characteristic diagram of cooling water, respectively, over the entire flow width of a heat transfer area in a conventional cross-current type plate heat exchanger.
Figure 2:
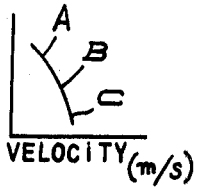
Figure 3:
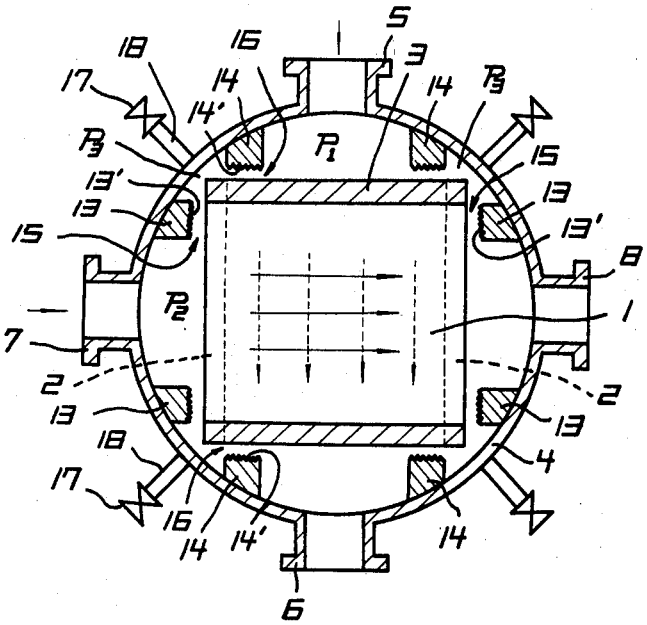
FIG. 3 is a longitudinal section of a cross-current type plate heat exchanger according to the present invention.

FIG. 3 is a longitudinal section of a cross-current type plate heat exchanger according to the invention, wherein a plurality of vertically disposed heat transfer plates 1 are arranged side by side to define fluid passageways and the top and bottom sides and the opposed lateral sides of said fluid passageways are alternately closed by gaskets 2 and 3, respectively, so that two fluids to be heat exchanged, for example, vapor and cooling water may flow respectively through alternate fluid passageways in a cross-current fashion. The assembly is housed in a casing 4. Thus, the lateral sides, namely, cooling water inlet and outlet sides, of alternate heat transfer plates 1 are sealed by the gaskets 2 while the top and bottom sides, namely, vapor inlet and outlet sides, of the remaining heat transfer plates 1 are sealed by the gaskets 3, so that the fluid passageways which allow the passage of vapor and cooling water, respectively, prevent the passage of cooling water and vapor, respectively. More particularly, vapor is fed in through the vapor feed ports 5 and vertically flows through the associated fluid passageways and is taken out through the vapor delivery ports 6 below, while cooling water is fed in through the cooling water feed ports 7 and horizontally flow through the associated fluid passageways and is taken out through the cooling water delivery ports 8 on the opposite side. In this manner, heat exchange between vapor and cooling water is effected through the heat transfer plates 1.

A first feature of the invention lies in the fact that the heat transfer plates 1 which define the fluid passageways for two fluids to be heat exchanged are formed with a plurality of juxtaposed vertical grooves 9 extending from the top to the bottom of each heat transfer surface, while a plurality of substantially horizontal projections 10 are formed between said vertical grooves 9 to vertically divide each heat transfer area into a plurality of sections between said vertical grooves 9 and vertically extending short projections 11 which are lower than said vertical grooves are provided between said projections 10 in such a manner that the number of such short projections provided in the vertically separated sections is progressively increased so that the bottommost section has the greatest number of short projections.

Figure 8:
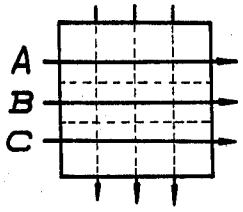
FIGS. 8 and 9 are a flow distribution characteristic diagram and a flow rate characteristic diagram of cooling water, respectively, over the entire flow width of a heat transfer area according to the invention.
Figure 9:
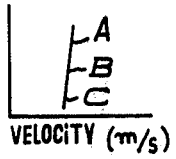
Figure 4:
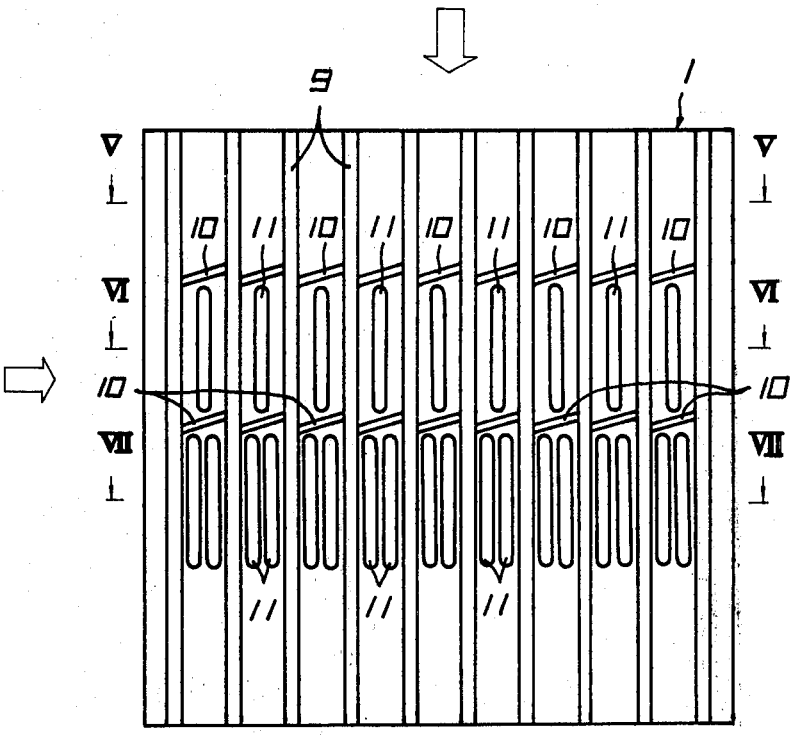
FIG. 4 is a plan view of a heat transfer plate according to the invention.
Figure 5:
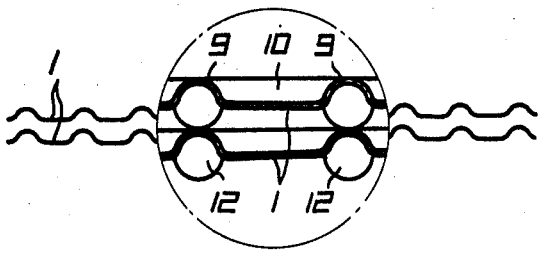
FIGS. 5, 6 and 7 are partly enlarged cross-sections taken along the lines V—V, VI—VI and VII—VII of FIG. 4, respectively.
Figure 6:
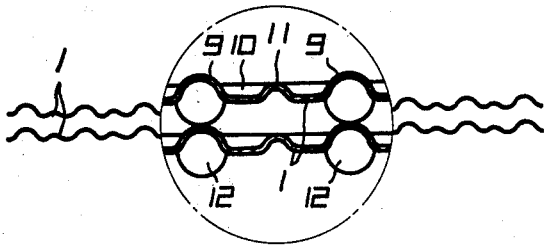
Figure 7:
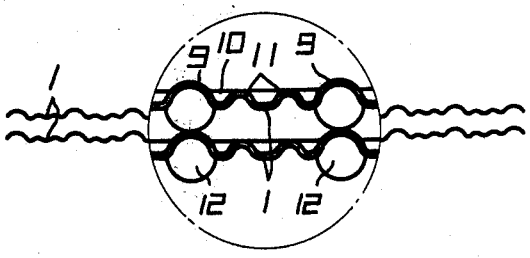

With the arrangement described above, cooling water which is fed in laterally of the heat transfer plates 1 and horizontally flows will encounter less resistance due to the vertically extending short projections 11 in an upper section than in a lower section in each heat transfer area since the number of said short projections in each section is progressively increased as the heat transfer area is traced from top to bottom, so that the cooling water flows uniformly over the entire flow width of each heat transfer area. Further, since the substantially horizontal projections 10 formed between the vertical grooves 9 to transversely divide each heat transfer area prevent the graviational flow of the cooling water, it will flow at a uniform flow rate over the entire flow width of each heat transfer area without the flow rate in one section being influenced by the flow rate in the adjacent sections. Therefore, the flow of the cooling water can be prevented from deviating, and a uniform flow distribution can be obtained over the entire flow width of each heat transfer area, as shown in FIGS. 8 and 9. Thus, the improvement of film coefficient on the cooling water side and the reduction of pressure loss are attained because of the elimination of the dead space. As a result, treatment in large quantities has become possible. In addition, the numeral 12 designates contact members disposed here and there, which, as is apparent from the cross-sectional view of the heat transfer plates 1 assembled as shown in FIGS. 5 through 7, serve to maintain the adjacent heat transfer plates 1 at a fixed spacing and also serve to add to the strength of the assembly.

Another feature of the invention lies in the fact a sealing construction utilizing labyrinth effect is employed. More particularly, fins 13' and 14' are formed on the surfaces of gaskets 2 and 3 facing seal members 13 and 14 disposed between the heat transfer plates 1 and the casing 4, thereby defining labyrinths 15 and 16 in a space between the seal members 13 and 14 and the gaskets 2 and 3. With this arrangement, when the vapor and cooling water flow into the labyrinths 15 and 16, the so-called labyrinth effect takes place wherein each time they flow from a narrower clearance into a wider clearance, the energy flowing out of the narrower clearance is consumed in the wider clearance so that the pressure is gradually reduced, whereby effective sealing can be achieved. Therefore, the short passing of the vapor and cooling water between the plates 1 and the casing 4 can be prevented. Further, compressed air is fed into the labyrinths 15 and 16 through pipes 17 and 18. The pressure $P_3$ of the compressed air is higher than the pressure $P_1$ of the vapor and the pressure $P_2$ of the cooling water. Since the compressed air is higher in pressure than the fluids to be heat exchanged, a small amount of said compressed air will leak into the vapor or cooling water passageways through the labyrinths, but this does not matter since the amount of leakage can be kept below 5%. Thus, the mixing of the two fluids to be heat exchanged can be avoided and the rate of heat transfer can be increased.

Although the foregoing description refers to an embodiment of the invention applied to heat exchange between vapor and cooling water, the invention may, of course, be applied to heat exchange between two other fluids and compressed air may be replaced by other gas.

What is claimed is:

1. A cross-current type plate heat exchanger comprising a casing, a plurality of vertically disposed heat transfer plates arranged side by side within said casing to define fluid passageways through which two fluids to be heat exchanged flow in a cross-current manner, wherein each heat transfer plate includes a plurality of juxtaposed vertical grooves extending from the top to the bottom of the heat transfer surface of said heat transfer plate, a plurality of substantially horizontal projections positioned between the vertical grooves for dividing said heat transfer area into a plurality of sections, and vertically extending short projections which are lower than the vertical grooves positioned between the substantially horizontal projections wherein the number of said short projections provided in the vertically separated sections is progressively increased as the heat transfer area extends from top to bottom.

2. A cross-current type plate heat exchanger as set forth in claim 1 including a gasket means positioned on the edges of said heat transfer plates and seal means positioned between said casing and said heat transfer plates wherein the space between said gasket means and said seal means defines a labyrinth wherein a gas having a higher pressure than that of any of the fluids to be heat exchanged is fed to said labyrinth.

* * * * *